US007535285B2

(12) United States Patent
Colman

(10) Patent No.: US 7,535,285 B2
(45) Date of Patent: May 19, 2009

(54) BAND-GAP VOLTAGE REFERENCE CIRCUIT

(75) Inventor: Derek Colman, Bromham (GB)

(73) Assignee: Texas Instruments Incorporated, Dallas, TX (US)

( * ) Notice: Subject to any disclaimer, the term of this patent is extended or adjusted under 35 U.S.C. 154(b) by 50 days.

(21) Appl. No.: 11/537,787

(22) Filed: Oct. 2, 2006

(65) Prior Publication Data

US 2007/0076483 A1 Apr. 5, 2007

(30) Foreign Application Priority Data

Sep. 30, 2005 (GB) ..... 0519987.2

(51) Int. Cl.
*G05F 1/10* (2006.01)
*G05F 3/02* (2006.01)

(52) U.S. Cl. ..... 327/539; 327/542; 323/313; 323/316; 323/901

(58) Field of Classification Search ..... 327/538–543; 323/311–317, 901
See application file for complete search history.

(56) References Cited

U.S. PATENT DOCUMENTS

| | | | | |
|---|---|---|---|---|
| 6,160,391 | A | 12/2000 | Banba | |
| 6,222,399 | B1 | 4/2001 | Imbornone et al. | |
| 6,242,898 | B1 * | 6/2001 | Shimizu et al. | 323/313 |
| 6,323,630 | B1 | 11/2001 | Banba | |
| 6,847,240 | B1 * | 1/2005 | Zhou | 327/143 |
| 7,224,209 | B2 * | 5/2007 | Hsu | 327/538 |
| 7,286,002 | B1 * | 10/2007 | Jackson | 327/539 |

FOREIGN PATENT DOCUMENTS

| | | | |
|---|---|---|---|
| JP | 2003263232 | A | 9/2003 |
| JP | 2006134126 | A | 5/2006 |

OTHER PUBLICATIONS

Banba et al, "A CMOS Bandgap Reference Circuit with Sub-I-V Operation", Proc. IEEE Journal of Solid-State Circuits, vol. 34, No. 5, pp. 670-674, May 1999.*
Waltari et al., "Reference Voltage Driver for Low-Voltage CMOS A/D Converters", Proc. IEEE International Conference on Electronics, Circuits and Systems, pp. 28-31, Dec. 2000.*
Uyemura, John P. "Introduction to VLSI Circuits and Systems", John Wiley and Sons Inc, 2002, p. 351.*

* cited by examiner

*Primary Examiner*—Donovan Lincoln
*Assistant Examiner*—Patrick O'Neill
(74) *Attorney, Agent, or Firm*—John J. Patti; Wade J. Brady, III; Frederick J. Telecky, Jr.

(57) ABSTRACT

A reference circuit. Included are first and second reference circuit blocks, first and second controllable current sources connected to supply current through the first and second reference circuit blocks respectively, an amplifier having non-inverting and inverting inputs responsive to the voltages developed by the first and second reference circuit blocks respectively and having an output connected to control the currents provided by the first and second current sources, and an output stage having a reference output controlled by the output of the amplifier. The reference circuit further comprises start-up circuitry, including a latch having an output indicating its state and being responsive to a signal indicative of the output from the reference output to latch from a first state into a second state when that signal passes a first threshold, and a switch that is responsive to the output of the latch to supply a control signal.

18 Claims, 4 Drawing Sheets

BAND-GAP VOLTAGE REFERENCE CIRCUIT

TECHNICAL FIELD OF THE INVENTION

The present invention relates to reference circuits.

BACKGROUND OF THE INVENTION

A So-called "band-gap" voltage reference circuits are well known in the art, and are used to provide an output voltage, often of around 1.2V, that is invariant with changes of temperature and also with changes in supply voltage. These circuits operate by providing an output that has one term that has a positive temperature coefficient and one term that has a negative temperature coefficient. These are added together by the circuit in appropriate proportions so that the overall temperature coefficient of the output is zero.

Bandgap circuits suitable for inclusion in an integrated circuit have long been known. The need for integrated circuits to operate off 1V (or lower) power supplies has also long been recognized.

Banba et al, "A CMOS Bandgap Reference Circuit with Sub-1-V Operation", Proc. IEEE Journal of Solid-State Circuits, Vol. 34, No. 5, pp. 670-674, May 1999, discloses a bandgap voltage reference circuit that is designed for CMOS construction and to operate using a supply voltage of under 1V.

FIG. 1 is a schematic diagram of the bandgap circuit proposed by Banba et al. The circuit comprises an op-amp 1 whose output 2 is connected to the gates of PMOS transistors 3 and 4, which have their sources connected to a positive supply 5 ($V_{DD}$); so transistors 3 and 4 provide equal currents $I_3$ and $I_4$ from their drains respectively. The drain of transistor 3 is connected to a ground power supply 6 ($V_{SS}$) via both a resistor 7 and a forward biased diode 8 arranged in parallel. The drain of transistor 4 is connected to $V_{SS}$ via a resistor 9. Connected in parallel with the resistor 9 is a network comprising a resistor 10 connected in series with a set of N forward biased diodes 11 connected in parallel with each other.

The drains of transistors 3 and 4 are also connected respectively to the inverting and non-inverting inputs of op-amp 1. Op-amp 1 operates to ensure that the voltages ($V_{INN}$ and $V_{INP}$) at its inverting and non-inverting inputs are equal (since the op-amp has very high gain). Resistors 7 and 9 have the same resistance, with the result that the currents through them $I_7$ and $I_9$ respectively are equal (since $V_{INN}$ and $V_{INP}$ are equal), which in turn means that the current through diode 8 ($I_8$) and that, $I_{10}$, through the network comprising resistor 10 and diodes 11 are equal (remember also that $I_3$ and $I_4$ are equal).

Now, the output 2 of the op-amp 1 is also connected to the gate of a PMOS transistor 12; this has its source connected to $V_{DD}$ and its drain connected to ground via a resistor 13. The reference voltage $V_{REF}$ output of the circuit is that across the resistor 13 and may be calculated as follows:

$$V_{REF}=R_{13}\cdot I_{12}$$

where $R_{13}$ is the resistance of resistor 13 and $I_{12}$ is the current supplied from the drain of transistor 12.

Now, since $I_{12}=I_4$ because transistor 12 is the same size as transistors 3 and 4, and $I_4=I_9+I_{10}$, $$V_{REF}=R_{13}\cdot(I_9+I_{10})=R_{13}\cdot(V_{INP}/R_9+V_{10}/R_{10})$$

where $V_{10}$ is the voltage across reistor 10, and further $$V_{REF}=R_{13}\cdot(V_{INN}/R_9+V_{10}/R_{10}) \text{ since } V_{INP}=V_{INN}.$$

Now $V_{INN}$ is the forward bias voltage $V_{f8}$ across diode 8 and $V_{10}$ is related to the forward bias voltage $V_{f11}$ across the N diodes 11 in a parallel (each carrying 1/N of the current flowing through diode 9) by:

$$V_{10}=V_{INP}-V_{f11}=V_{INN}-V_{f11}=V_{f8}-V_{f11}$$

but since (as is known in the art) for both diodes 8 and 11 $V_f=V_T$. In $(I/I_S)$ where $V_T$ and $I_S$ are constants and are the same for all the diodes because diodes 8 and 11 are all identical, it follows that:

$$\begin{aligned} V_{10} &= V_T(\ln(I_8/I_S)-\ln((I_8/N)/I_S) \\ &= V_T\cdot\ln(N), \end{aligned}$$

and that therefore $$V_{REF}=R_{13}\cdot(V_{f8}/R_9+V_T\cdot\ln(N)/R_{10}).$$ (This analysis is disclosed by Banba et al.).

Thus the reference voltage $V_{REF}$ depends on the forward bias voltage developed by a diode, which decreases with temperature, and on the constant $V_T$ (the "thermal voltage") which increases with temperature. These two effects can be balanced by the choice of resistor values. The reference voltage $V_{REF}$ is fairly independent of the temperature effects on the resistances since it depends on ratios of resistance values.

The circuit is also provided with a transistor 14 which is turned on by a RESET signal during a power-up or reset operation. Transistor 14 is then turned off and the circuit is allowed to find its operating point. Switching on this transistor apparently establishes currents $I_4$, $I_3$ and $I_{12}$ at the maximum possible values. It is believed however that once transistor 14 is turned off (by the RESET signal) the bandgap reference circuit will not reliably establish itself at the desired stable operating point, of which there are at least two. Since the circuit is released abruptly it may pass straight through the desired operating point to the stable state where the inputs to the op-amp are OV and no currents flow.

Waltari and Halonen, "Reference Voltage Driver for Low-Voltage CMOS A/D Converters", Proc. IEEE International Conference on Electronics, Circuits and Systems, pp. 28-31, December 2000 (available at least at http://www.ecdl.hut.fi/~mwa/publications), discloses a similar bandgap voltage reference circuit that is also designed to operate using a supply voltage of under 1V; in fact, as they say, they took the bandgap circuit of Banba et al and made some modifications.

FIG. 2 shows the circuit proposed by Waltari and Halonen. This uses similar reference numerals for parts similar to those of the circuit of FIG. 1. In this circuit only a proportion of the voltages (i) across the diode 8, or (ii) the network of diodes 11 and the resistor 10, are fed back to their op amp 1, which is said to be to move those voltages into a suitable range for input to their op amp 1. This is done by splitting each of the resistors 7 and 9 into two (7*a* and 7*b*; 9*a* and 9*b*) and taking the op-amp inputs from the nodes in between the respective resistor pairs.

Another modification is cascode transistors 21, 22 and 23 which have their current paths connected respectively in series between the drains of transistors 3, 4 and 12 and resistor 7, resistor 9 and resistor 13 respectively. The gates of the transistors are connected to a bias $V_{biasC}$ provided by a bias circuit 24, which is responsive to the output of the op-amp. The cascode transistors are employed to improve the output impedance of the current sources formed by transistors 3, 4 and 12.

Waltari and Halonen also provide a start-up circuit. This is shown in FIG. 3. The start-up circuit 30 comprises an NMOS transistor 31 controlled by the voltage across diode 8 (via connection 32 to the circuit of FIG. 2). When that voltage falls below the threshold voltage of that transistor 31, the transistor 31 is off and so current is drawn through a resistor 33 via transistor 34. This current is mirrored via transistors 34, 35 and 36 and 37 and is injected back into the node monitored by transistor 31, which node is supplied with current by transistor 3, in order to ensure that current is supplied to diode 8 and resistor 7, thereby avoiding the alternative and undesirable operating point in which the voltage across the diode 8 and the resistor 9 is zero. When the reference circuit is in its desired operating point transistor 31 is on and draws all the current from resistor 33 leaving no (i.e. zero) current to be mirrored by transistor 34 to transistor 37. The startup circuit 30 also injects a current into the bias circuit, in that situation (from transistor 38 via connection 32).

Waltari and Halonen say that, when the voltage across the diode 8 is well above the threshold of transistor 31, the startup circuit has no effect on their bangap circuit.

Both Banba et al and Waltari and Halonen use diode connected PNP bipolar transistors for their diodes, which can be fabricated as vertical devices in the CMOS process.

SUMMARY OF THE INVENTION

The following summary presents a simplified description of the invention, and is intended to give a basic understanding of one or more aspects of the invention. It does not provide an extensive overview of the invention, nor, on the other hand, is it intended to identify or highlight key or essential elements of the invention, nor to define the scope of the invention. Rather, it is presented as a prelude to the Detailed Description, which is set forth below, wherein a more extensive overview of the invention is presented. The scope of the invention is defined in the Claims, which follow the Detailed Description, and this section in no way alters or affects that scope.

The present invention is a reference circuit. Included are first and second reference circuit blocks, first and second controllable current sources connected to supply current through the first and second reference circuit blocks respectively, an amplifier having non-inverting and inverting inputs responsive to the voltages developed by the first and second reference circuit blocks respectively and having an output connected to control the currents provided by the first and second current sources, and an output stage having a reference output controlled by the output of the amplifier. The reference circuit further comprises start-up circuitry, including a latch having an output indicating its state and being responsive to a signal indicative of the output from the reference output to latch from a first state into a second state when that signal passes a first threshold, and a switch that is responsive to the output of the latch to supply a control signal, when the latch is in the first state, to control the first and second current sources and that is switched off when the latch is in the second state.

These and other aspects and features of the invention will be apparent to those skilled in the art from the following detailed description of the invention, taken together with the accompanying drawings.

DETAILED DESCRIPTION OF THE PREFERRED EMBODIMENTS

The making and use of the various embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

Figure 4:
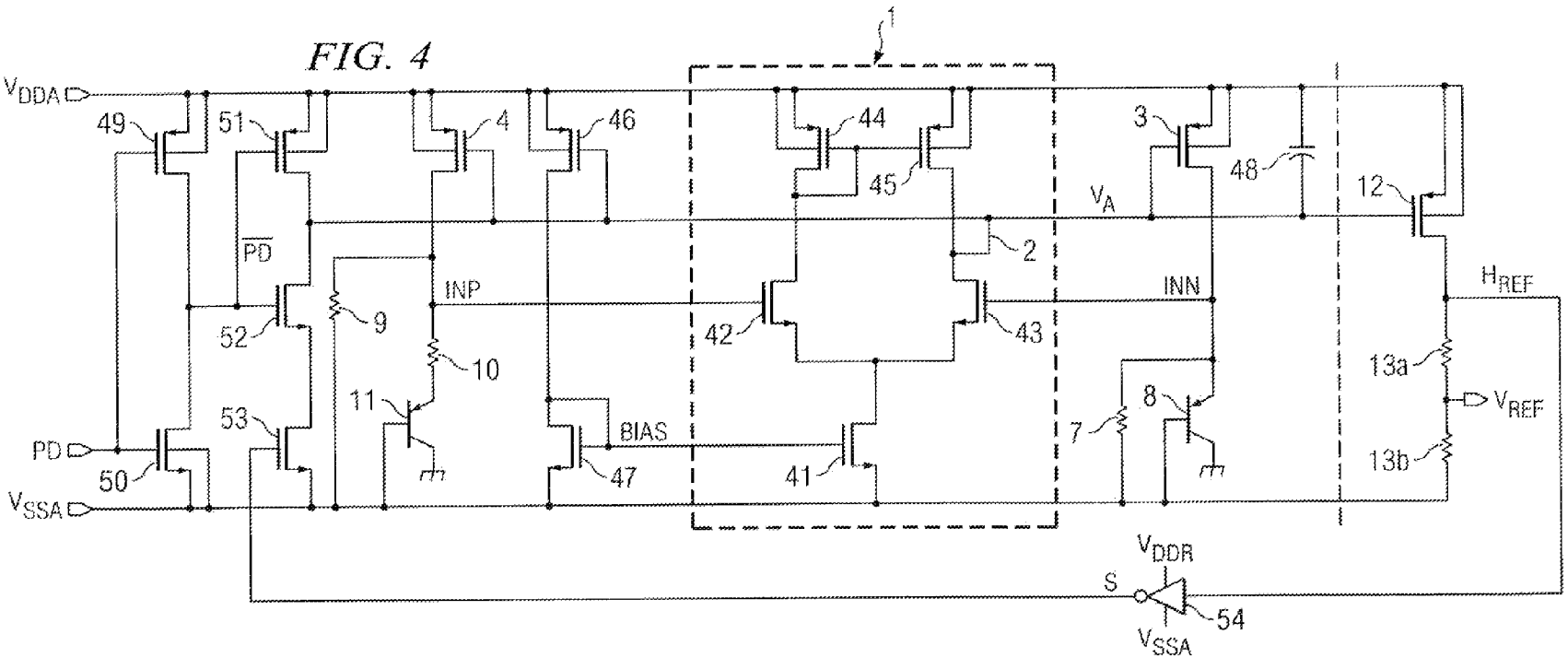
FIG. 4 is a diagram of a reference circuit according to the present invention.

FIG. 4 shows a reference circuit according to the present invention. In particular the circuit is a voltage reference circuit and is a bandgap reference circuit, and further the voltage reference section is similar to that of Banba et al, and similar reference numerals have been provided for similar parts.

This circuit also uses diode connected PNP transistors for the diodes 8 and 11.

Transistors 41 to 45 provide the op amp 1. Transistor 41 is an NMOS transistor providing a current source, with the current being set by a bias stage connected to the gate. Its source is connected to the ground power supply $V_{SSA}$ and its drain to the sources of two NMOS transistors 42 and 43 the gates of which form the non-inverting and inverting inputs of the op amp 1. The drains of transistors 42 and 43 are respectively connected to the drains of PMOS transistors 44 and 45, whose sources are connected to the positive supply $V_{DDA}$. Transistors 44 and 45 are connected in current mirror configuration with their gates being connected to the node between transistors 42 and 44. The output of the op-amp 1 is provided by the node between transistors 43 and 45. The bias stage comprises transistors 46 and 47. PMOS transistor 46 has its source connected to $V_{DDA}$ and its gate connected to the output of the op amp 1. The drain current of transistor 46 set thereby is received by the drain of NMOS transistor 47, which has its source connected to $V_{SSA}$.The gate of transistor 47 is connected to its drain and also to the gate of transistor 41 (of the op amp 1) to bias it so that the current transistor 41 provides is mirrored from that supplied by transistor 46. Banba et al discloses the same transistor implementation of the op-amp 1 and its bias stage.

An op-amp is a form of amplifier. The function of this circuit element here is to amplify the difference in voltage between the voltage across diode 8 and that across resistor 10 and diodes 11. Any amplifier block that will perform that function will suffice, irrespective of whether it is called an op-amp. High gain is preferred because the higher the gain the smaller the offset between those two voltages at the operating point and the nearer the ideal the circuit will function.

For its diodes 8 and 11 the circuit of this example of the invention also uses diode connected PNP bipolar transistors.

Although only one bipolar transistor symbol is marked in FIG. 4 for diode 11 there are in fact in this example fifteen (marked as "PNP 15 units") similarly connected in parallel with each other, but there is only one device for diode 8. All the devices 8 and 11 are of the same size. The circuit of FIG. 4 also has a capacitor 48 connected between the output of the amplifier 1 and $V_{DDA}$ which stabilizes the feedback loop around the amplifier 1 (i.e. that keeping $V_{INP}$ and $V_{INN}$ equal). Banba at al also discloses a similarly connected capacitor, which is also for the purpose of stabilizing the feedback loop.

As has been explained above the circuit functions by biasing two reference circuitry blocks (which in the example are the networks 7, 8 and 9, 10, 11 of resistors and diodes) with currents so that equal voltages are established across them. The particular content of those blocks is not, as will become apparent, essential to the invention, which is applicable if other elements are used. Indeed the invention would still be applicable if their content produced a voltage reference at the output that was a non-constant function of temperature, which conceivably may be useful in some circumstances. Indeed the invention also applies where the reference circuit is used to supply a reference current.

Figure 9A:
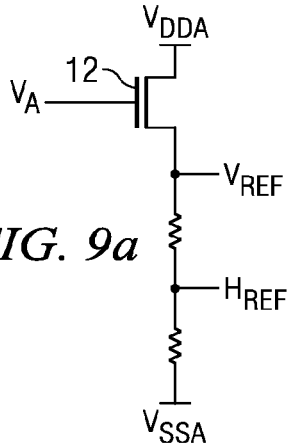
FIGS. 9*a* to 9*d* show alternative output stages for the circuit of FIG. 4.
Figure 9B:
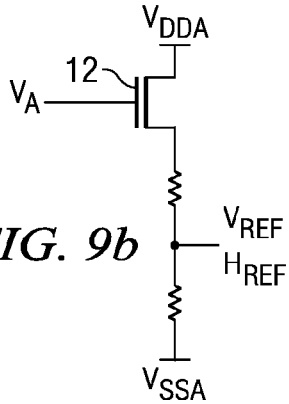
Figure 9C:
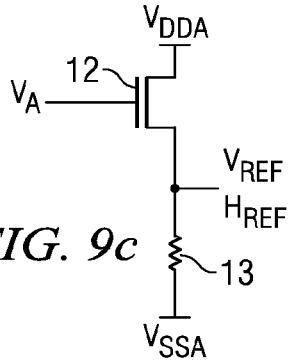

The circuit of the invention is different from the circuit disclosed by Banba et al as explained below. The resistor 13 across which the output reference voltage is developed is split into two resistors 13*a* and 13*b*, which are connected in series in place of resistor 13. This allows the reference output $V_{REF}$, which is taken from the node between resistors 13*a* and 13*b* to be a proportion of the full voltage value across the combined resistance of resistors 13*a* and 13*b*. This allows any desired value of reference voltage to be set independently of the input level required by Schmitt trigger 54 (see below). It would also be possible, if required, for the Schmitt trigger input $H_{REF}$ to be taken from the node between resistors 13*a* and 13*b* and the output reference voltage from the node between resistor 13*a* and transistor 12 as shown in the alternative output stage of FIG. 9*a*. Alternatively $H_{REF}$ and $V_{REF}$ could, if the levels are suitable in a particular case, be taken from the same node, for example as shown in FIG. 9*b* where they are taken from the node between resistors 13*a* and 13*b*, or as shown in the in FIG. 9*c* from the node between resistor 13 and the drain of transistor 12.

According to the invention the exemplary circuit of FIG. 4 also comprises start-up circuitry. One of the component of the start-up circuitry is the initialization circuit, which is comprised of inverter 49 and 50, PMOS transistor 51, and NMOS transistor 52. In operation, a power-down signal PD is inverted by a CMOS inverter comprising PMOS transistor 49 and NMOS transistor 50. (This is connected in the conventional way with the input signal PD connected to the gates of both transistors 49 and 50. The sources of those transistors are respectively connected to $V_{DDA}$ and $V_{SSA}$ and their drains are connected together, at which point the inverted output is provided.) The inverted signal PD is connected to the gates of PMOS transistor 51 and NMOS transistor 52. The source of transistor 51 is connected to $V_{DDA}$ and its drain to the drain of transistor 52. That in turn has its source connected to the drain of an NMOS transistor 53, which has its source connected to $V_{SSA}$. The node between the drains of transistors 51 and 52 is connected to the output of the amplifier 1 to control the level of that node during start-up (and hence to control the amount of current provided by transistors 3 and 4 to bias the reference networks 7, 8 and 9, 10 and 11. The gate of NMOS transistor 53 is connected to be controlled by the output of the Schmitt trigger 54, whose input is connected to the node between the drain of transistor 12 and resistor 13*a* and is thus responsive to the voltage level HREF at that node. Transistor 53 is a weak transistor meaning it supplies a small current. This is done in this example by making it with a channel that is longer than it is wide, in contrast with the others of the circuit of FIG. 4 which are generally wider than they are long or have roughly equal width and length.

Figure 5:
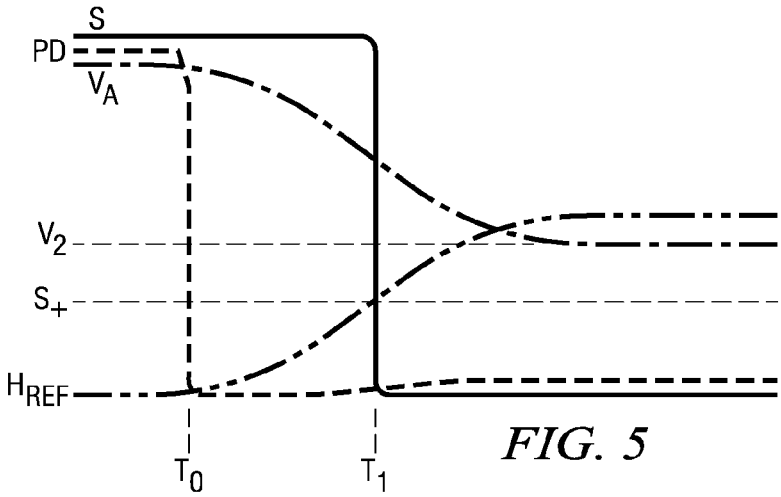
FIG. 5 is a timing diagram of signal levels in the circuit of FIG. 4 on start-up.

FIG. 5 is a timing diagram of signal levels in the circuit of FIG. 4 on start-up. Before time $T_0$, PD is high, preventing the circuit from operating since the node at the output of the amplifier 1 is held high by transistor 51 (with transistor 52 being off), which turns off transistors 4, 46, 3 and 12. Since transistor 12 is off HREF is pulled low by resistors 13*a* and 13*b*. In this state the inputs to the amplifier 1 are also pulled low, turning off transistors 42 and 43. This is a stable state of the circuit, but not the desired operating state which requires current through the resistors 7, 9 and 10 and the diodes 8 and 11.

At time $T_0$, to initialise the circuit, PD is made low, and so transistor 51 is turned off, and transistor 52 is turned on; initially HREF remains low, meaning that S, the signal from the Schmitt trigger 54, is high. (The Schmitt trigger inverts its input level.) Therefore transistor 53 is on, which allows the start-up circuitry to operate. As shown in FIG. 5 HREF begins to rise as $V_A$, the level on the output of the amplifier, falls—at this stage $V_A$ is controlled by transistor 53, which, inter alia, controls the voltage on the gate of transistor 12. This proceeds slowly because the small current output by transistor 53 takes some time to charge capacitor 48.

At time $T_1$, HREF reaches level S+, the higher threshold of the Schmitt trigger 54, and so its output S drops to low. The transistor 53 is therefore turned off, preventing the start-up circuitry from operating i.e. the start-up circuitry no longer controls the output node of the amplifier 1. The value of S+ is chosen to correspond to $V_A$ being high enough that the feedback loop of the bandgap circuitry will, once released from the start-up circuitry, naturally stabilize at the desired operating point.

Figure 6:
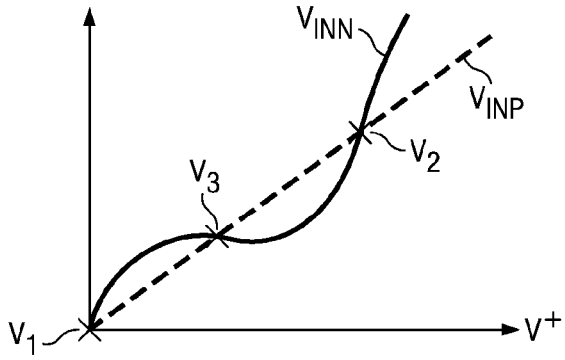
FIG. 6 is a graph of an operating point analysis relevant to the start-up circuit of the second known reference circuit.
Figure 7:
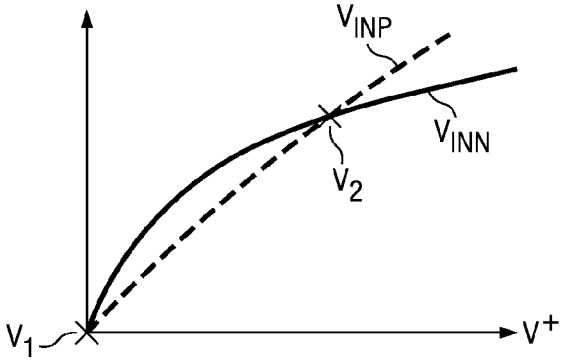
FIG. 7 is a graph of an operating point analysis relevant to the circuit of FIG. 4 (without start-up circuitry attached).

It has been noted by the inventor that the start-up circuit proposed by Waltari and Halonen contributes to the feedback loop around the amplifier 1. The inventor has simulated the circuit of FIG. 4 but with the start-up circuit of Waltari and Halonen (FIG. 3), rather than that of the invention. FIG. 6 shows for the simulated circuit two curves derived from the simulation. In the simulation the node labelled INP was disconnected from the non-inverting input of the amplifier 1, and the response of the circuit has been plotted against a range of voltages V+ applied to the non-inverting input. One curve (marked $V_{INP}$) is for that applied voltage itself, so is a straight line, and the other is $V_{INN}$. The stable operating points are at the intersections of the curves since at that point $V_{INP}=V_{INN}$. FIG. 7 shows a similar curve for the circuit of FIG. 4 with no start-up circuitry connected.

Figure 1:
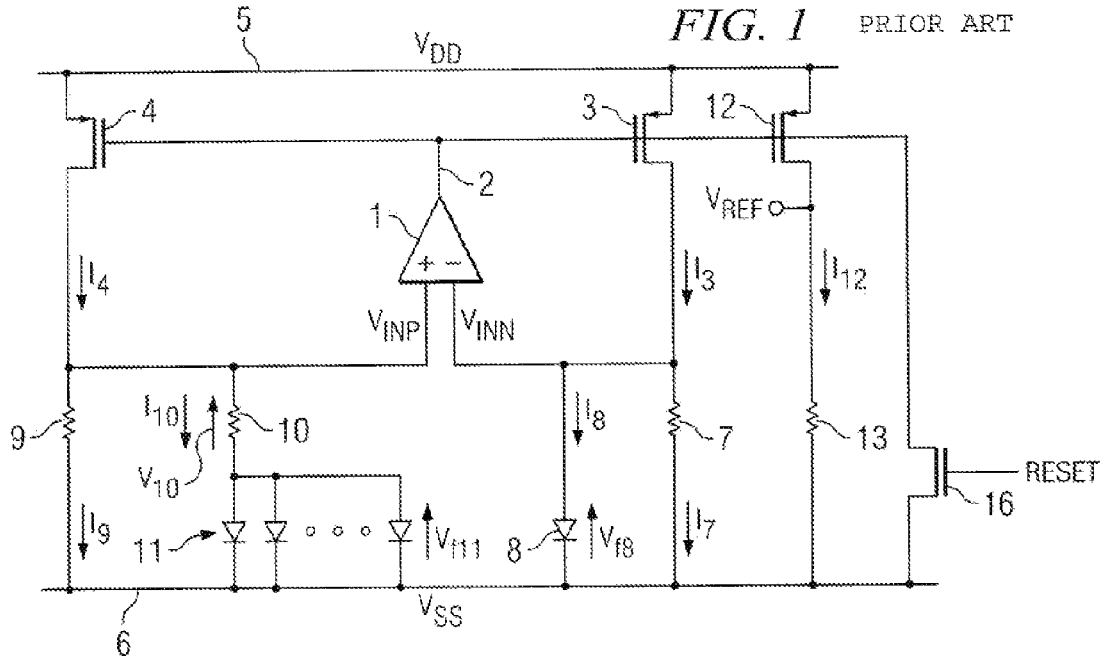
FIG. 1 PRIOR ART
FIG. 1 is a diagram of a first known voltage reference circuit.
Figure 2:
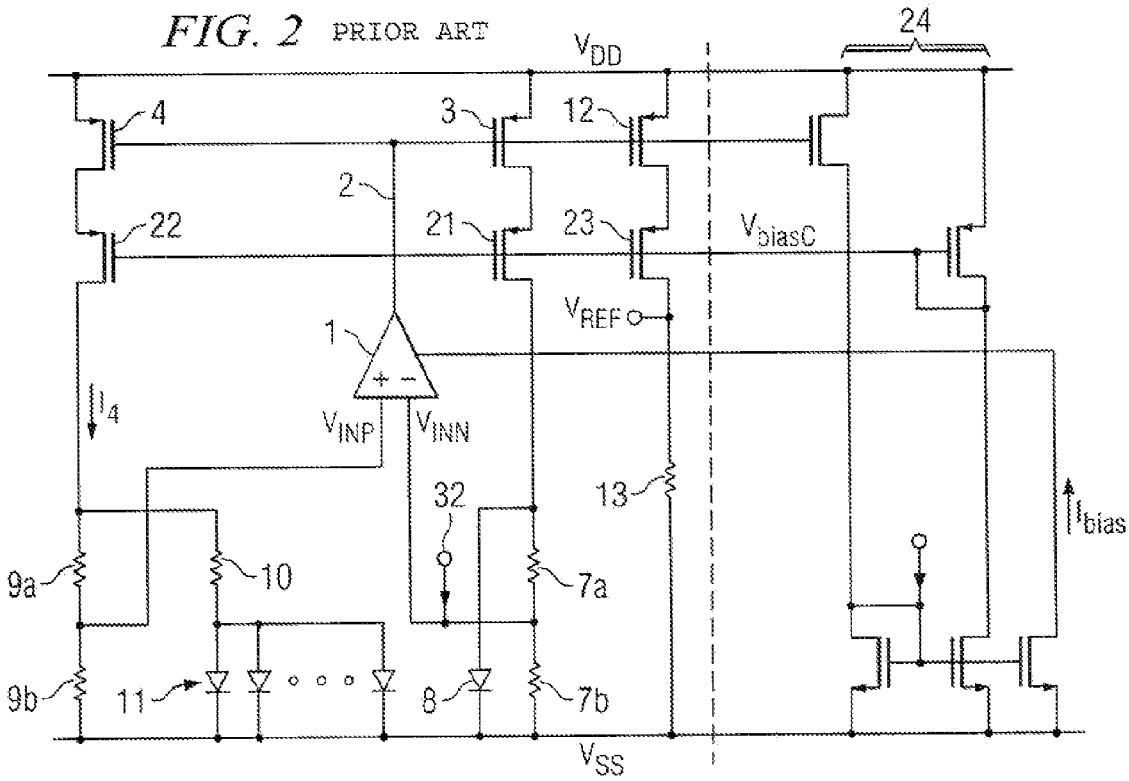
FIG. 2 PRIOR ART
FIG. 2 is a diagram of a second known voltage reference circuit.
Figure 3:
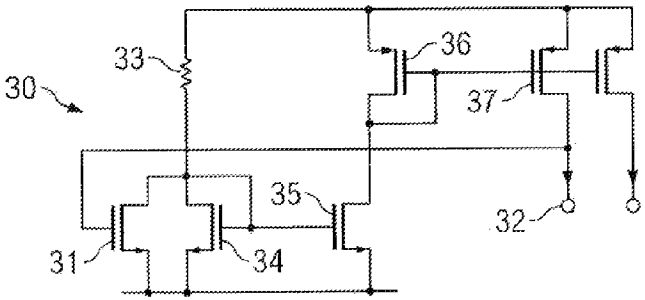
FIG. 3 PRIOR ART
FIG. 3 is a start-up circuit for the second known voltage reference circuit.

Comparing FIG. 6 to FIG. 7 it will be seen that the operation of the comparator feedback loop is affected in such a way that with the startup circuit of FIG. 3 a third stable state V3 between the 0V stable state V1 and the desired stable state V2 may exist. It is believed, therefore, that after being initialized, the simulated circuit could settle on this new stable voltage V3, rather then the desired voltage V2. The simulated circuit may therefore not operate as desired.

With the start-up circuit of the present invention exemplified in the circuit of FIG. 4, however, the possibility of settling on this extra undesirable operating point is removed. Once the Schmitt trigger 54 has switched off the transistor 53 the start-up circuit is isolated from the amplifier's 1 feedback loop and therefore does not affect its operation, in which case the extra stable voltage V3 does not exist and so the circuit of FIG. 4 will settle to the desired operating point V2.

In particular once the need for the start-up circuit has boosted $V_A$ to a point where the circuit will settle to the desired operating point the Schmitt trigger 54 latches that condition and keeps the transistor 53 off. Therefore any small drops in HREF that might occur at the point the start-up circuitry is disabled will not affect the feedback loop, potentially introducing the extra stable operating point.

The Schmitt trigger provides a latching function because it exhibits hysteresis. It is not essential that a Schmitt trigger in particular is used to control the start-up circuitry: any circuit that responded to the HREF level by latching in response to HREF passing beyond a threshold would suffice.

A feature of a Schmitt trigger is that it will switch back if the input stimulus returns beyond a second threshold, but nonetheless the Schmitt trigger could be replaced in the circuit of FIG. 4 by a latch circuit that is simply responsive to HREF moving beyond the S+ threshold and that then latched into a permanent state that cannot be changed by any subsequent value of HREF. Such a replacement would still serve to isolate the start-up circuit (by turning off transistor 53) from the voltage reference circuit immediately the threshold is passed). With such a latch it may be preferable to provide another input to the latch that can be used to reset it. Such latching functions, including those provided by Schmitt triggers, are usually provided by circuits in which there is positive feedback.

Note also that the Schmitt trigger, or other latching circuit, need not be connected directly to HREF or VREF as marked in FIG. 4, merely some level related to them.

The noted problem of the start-up circuit of FIG. 3 may be caused by the transistor 31 remaining responsive to $V_{INN}$ as it passes through its threshold, i.e. the current supplied to node 32 simply gets smaller for each small change of $V_{INN}$. The latching function of the present invention ensures that immediately the threshold is passed the start-up circuitry is isolated from the voltage reference circuit and so cannot affect it.

Figure 8:
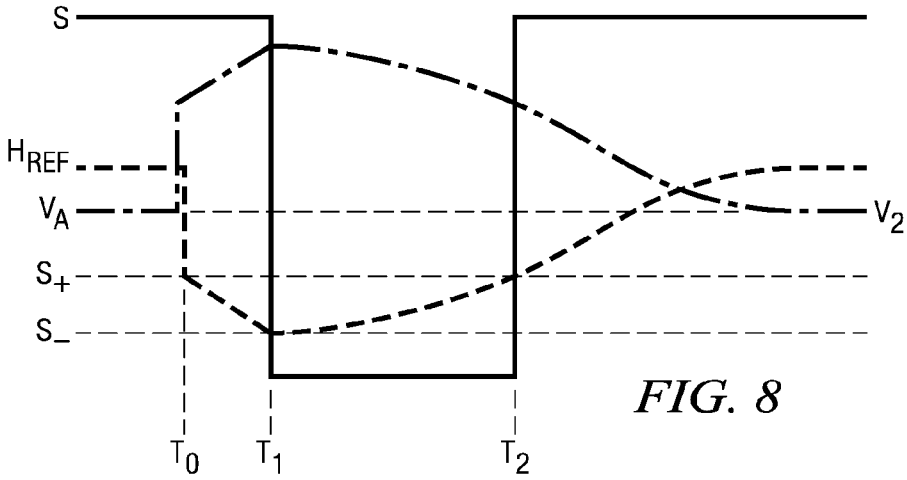
FIG. 8 is a diagram of signal levels in the circuit of FIG. 4 when an unintended voltage change during operation occurs.

The Schmitt trigger 54 is preferred because it provides a further function. FIG. 8 is diagram of signal levels in the circuit of FIG. 4 when an unintended voltage change during operation occurs. Before time $T_{10}$, the circuit operates at the desired stable voltage $V_2$, and so the signal from the Schmitt trigger 54 is low, turning off transistor 53. At time $T_{10}$, for some unintended reason (say a power supply fluctuation), HREF drops (and $V_A$ correspondingly rises). HREF is below S+, the high threshold of the Schmitt trigger 54, but not below S−, the low threshold, so S stays low. As the start-up circuitry is not operating, HREF begins to fall, as the feedback loop heads towards the low stable point $V_1$. (This would not always occur—if the voltage change had not been so great the feedback loop would simply head back to the desired voltage $V_2$.) At time $T_{11}$, HREF falls below the low threshold of the Schmitt trigger 54, causing S to become low. As before, HREF now rises until it at time $T_{12}$ it reaches the high threshold S+ of the Schmitt trigger 54, at which time S goes high, the start-up circuitry is disabled, and the feedback loop stabilizes on the desired voltage $V_2$. Thus the Schmitt trigger re-engages the start-up circuitry when the voltage reference circuit needs to be restarted, which condition is determined by HREF passing below the low thresholds of the Schmitt trigger.

The other modifications of the Bamba et al circuit proposed by Waltari and Halonen, namely the splitting of the resistors 7 and 9, and the cascode transistors may be employed in the circuit of the present invention.

The voltage reference circuit of the present invention may, of course, be used anywhere a voltage reference is required. The circuit may be integrated into an integrated circuit. Analogue circuits frequently require reference levels, but they are also required in digital circuits. CML is a form of digital logic that requires a defined bias current. Reference currents can be derived from a reference voltage using a voltage controlled current source. For example, the reference voltage $V_{REF}$ of the circuit of FIGS. 4, 9*a*, 9*b* and 9*c* can be so used.

Figure 9D:
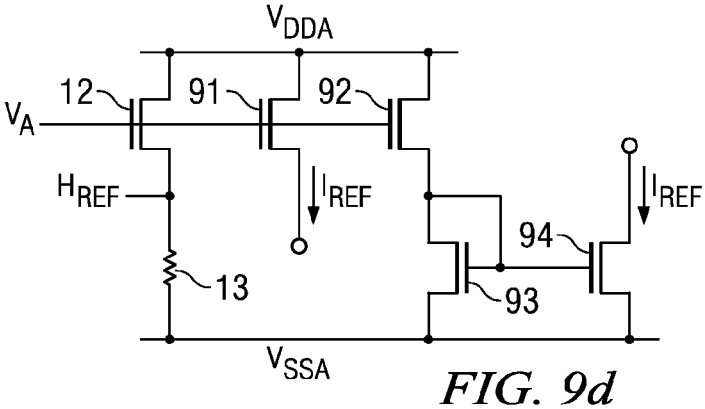

FIG. 9*d* shows another way of providing a reference current. FIG. 9*d* sis another form of output stage for the circuit of Figure. Another PMOS transistor 91 is provided having its gate connected to the output of the op amp 1 and its source connected to $V_{DDA}$; its drain provides the reference current.

A reference current sink can be provided as shown in FIG. 9*d*. Another PMOS transistor 92 similarly connected to transistor 91 provides a reference current which is then mirrored by NMOS transistors 93 and 94, with the drain of transistor 94 sinking the reference current from whatever circuit is utilizing it.

Although the present invention and its advantages have been described in detail, it should be understood that various changes, substitutions and alterations can be made herein without departing from the spirit and scope of the invention as defined by the appended claims. For example, . . . .

What is claimed is:

1. A reference circuit comprising:

first and second reference circuit blocks;

first and second controllable current sources connected to supply current through the first and second reference circuit blocks respectively;

an amplifier having non-inverting and inverting inputs responsive to the voltages developed by the first and second reference circuit blocks respectively and having an output connected to control the currents provided by the first and second current sources;

an output stage having a reference output controlled by the output of the amplifier; and start-up circuitry having:

a latch having an output indicating its state and being responsive to a signal indicative of the output from the reference output to latch from a first state into a second state when that signal passes a first threshold;

an initialization circuit block having an inverter that receives a power down signal, wherein the initialization circuit is coupled to the current sources, the output of the amplifier, and to the output stage, and wherein the initialization circuit includes a plurality of transistors coupled in series with one another that are each controlled by the inverter;

a switch that is coupled to at least one of the plurality of transistors of the initialization circuit block and that is responsive to the output of the latch to supply a control signal, when the latch is in the first state, to control the first and second current sources and that is switched off when the latch is in the second state.

2. A reference circuit as claimed in claim 1 wherein the start-up reference circuit is arranged to control the currents provided by the first and second current sources to increase over a period.

3. A reference circuit as claimed in claim 1 wherein the start-up circuitry comprises a current source.

4. A reference circuit as claimed in claim 3 wherein the current source of start-up circuit is a MOS transistor having its length greater than its width.

5. A reference circuit as claimed in claim 3 comprising a capacitor connected to integrate the current supplied by the current source of the start-up circuitry.

6. A reference circuit as claimed in claim 3 wherein the switch is connected to supply the current provided by the current source of the start-up circuitry as the control signal.

7. A reference circuit as claimed in claim 3 wherein the switch and the current source of the start-up circuit are provided by the same transistor.

8. A reference circuit as claimed in claim 3 wherein the output of the switch is connected to the output of the amplifier.

9. A reference circuit as claimed in claim 3 wherein the latch has a second threshold and is responsive to the signal indicative of the output from the reference output when that signal passes back beyond the first threshold and beyond a second threshold.

10. A reference circuit as claimed in claim 3 wherein the latch is a Schmitt trigger.

11. A reference circuit as claimed in claim 3 wherein the circuit has a power supply of 1.2 volts or less.

12. A reference circuit as claimed in claim 3 wherein the circuit provides a reference that is independent of temperature.

13. A reference circuit as claimed in claim 3 wherein the reference circuit blocks comprise resistors and diodes or diode connected transistors

14. A reference circuit as claimed in claim 3 wherein the amplifier is an op-amp.

15. A reference circuit as claimed in claim 3 wherein the output stage comprises a pair of resistors connected in series, the reference output is taken from the node between that pair, and the signal indicative of the reference output, to which the latch is responsive, is taken at one end of that pair.

16. An integrated circuit (IC) chip comprising the reference circuit as claimed in claim 15.

17. A reference circuit as claimed in claim 1 wherein the reference output and the signal indicative the reference output, to which the latch is responsive, are both taken from the same node in the output stage.

18. A reference circuits as claimed in claim 1 wherein the non-inverting and inverting inputs of the amplifier are connected to receive fractions of the voltages developed by the first and second reference circuit blocks provided by voltage dividers connected to receive those voltages.

* * * * *